United States Patent [19]

Duerring

[11] Patent Number: 4,930,328

[45] Date of Patent: Jun. 5, 1990

[54] METHOD AND APPARATUS FOR RELOADING A PILGERING MILL

[75] Inventor: Anthony A. Duerring, Kennewick, Wash.

[73] Assignee: Sandvik Special Metals Corp., Kennewick, Wash.

[21] Appl. No.: 297,431

[22] Filed: Jan. 17, 1989

[51] Int. Cl.[5] ..... B21B 17/06; B21B 21/00

[52] U.S. Cl. ..... 72/208; 72/214

[58] Field of Search ..... 72/208, 209, 214, 250, 72/252, 370

[56] References Cited

U.S. PATENT DOCUMENTS

| | | | |
|---|---|---|---|
| 3,030,835 | 4/1962 | Krause | 72/214 X |
| 3,570,294 | 3/1971 | Shibata | 72/214 X |
| 4,090,386 | 5/1978 | Naylor et al. | 72/208 |
| 4,157,025 | 6/1979 | Vydrin et al. | 72/214 X |
| 4,233,834 | 11/1980 | Matinlassi | 72/208 |
| 4,641,513 | 2/1987 | Peytavin | 72/214 |
| 4,655,068 | 4/1987 | Schemel | 72/208 |

FOREIGN PATENT DOCUMENTS

| | | | |
|---|---|---|---|
| 3304002 | 7/1984 | Fed. Rep. of Germany | 72/214 |

*Primary Examiner*—E. Michael Combs

*Attorney, Agent, or Firm*—Burns, Doane, Swecker & Mathis

[57] ABSTRACT

A method and apparatus for loading hollow workpieces into a pilgering mill. The pilgering mill includes a reciprocating roll stand having a pair of metal forming rolls, a mandrel for insertion into a workpiece, and a mechanism for clamping the workpiece with various degrees of pressure. During loading and unloading of the mill, the workpiece is restricted from movement within the pilgering mill according to the various pressures applied to the workpiece by the clamping mechanism.

16 Claims, 4 Drawing Sheets

Fig. 1
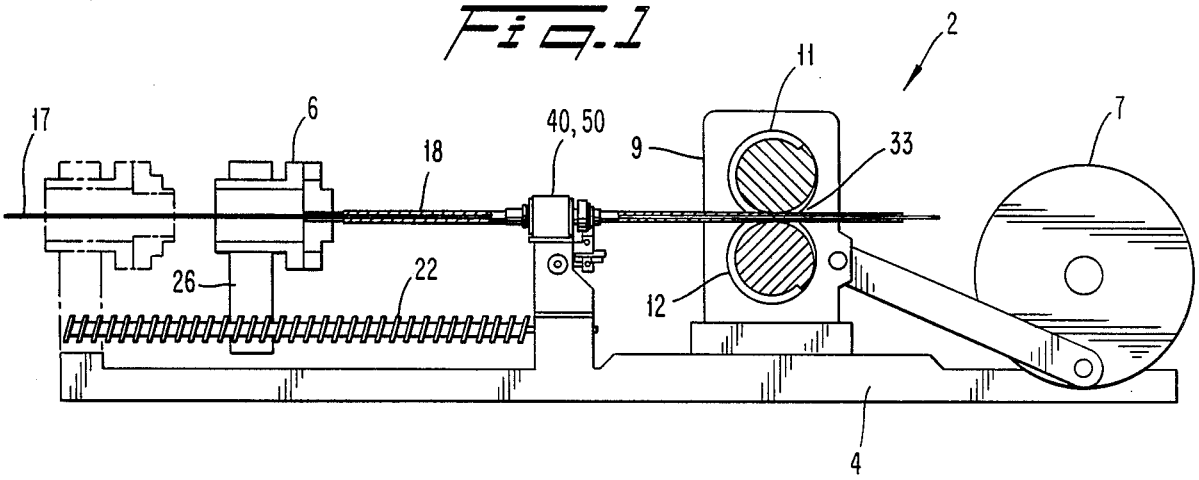
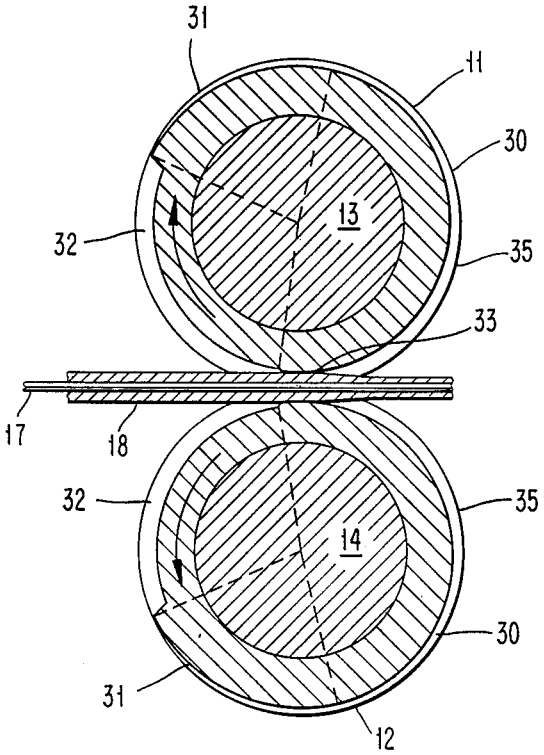
Fig. 2
Fig. 3
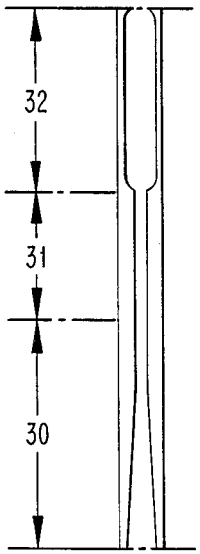

41
42
40
44
49
45
46
48
87
86
85
84
80
47
43
59
88
81
58
82
83

METHOD AND APPARATUS FOR RELOADING A PILGERING MILL

BACKGROUND AND SUMMARY OF THE INVENTION

This invention relates to the production of tubes from hollow workpieces, and in particular to methods and apparatus for facilitating the loading and unloading of such mills.

U.S. Pat. No. 4,090,386 relates to a method of producing zircaloy tubes where it is desired to have high rates of reduction in the wall thickness. The specification describes a McKay rocker wherein the mandrel which is employed in the reduction of the diameter of the tubing, is securely locked within a crosshead of the device along with the hollow or workpiece that will be reduced. During the forming or rolling operation, the crosshead advances the workpiece into a forming zone while the workpiece and mandrel are periodically turned by a clamp mounted on the crosshead.

U.S. Pat. No. 4,233,834 is similarly related to a method of producing zircaloy tubes and is specifically directed to tubing wherein the spiral formation of the wall thickness is controlled. As in the above described patent, the specification describes a McKay rocker mill wherein the mandrel and workpiece are securely clamped in a chuck which is located on a movable crosshead. As the crosshead moves the hollow or workpiece into the forming zone, the chuck periodically turns the workpiece.

U.S. Pat. No. 4,655,068 is directed to a method and apparatus of producing tubing generally and, in particular, is directed to a method of clamping a mandrel that is allowed to float in the workpiece. As in the above described U.S. patents, the specification describes a McKay rocker mill wherein a workpiece is moved into a forming or rolling zone by a movable crosshead while periodically being turned. However, in this arrangement, the mandrel is clamped in the crosshead with a force less than the mandrel's yield strength. Thus, tensile forces that might otherwise cause the mandrel to buckle while the workpiece is urged through the rolls are no longer applied to the mandrel.

Each of the above patents disclose methods that are, in varying degrees, acceptable for causing the workpiece along with the mandrel to travel through the tube-forming zone of the McKay rocker mill. That is, the methods for producing tubes disclosed therein are acceptable for the production of tubes in varying degrees of efficiency and economy. Over the course of practicing these methods, however, it has become apparent that a significant inefficiency and, therefore, an increase in cost is encountered not in the methods used to move the workpieces through the forming zone of the rolls, but in the operations required in reloading the mill.

Prior to understanding the problems in reloading the mill however, the general operation of the typical Mckay rocker mill must be understood. During a forming operation, the mandrel and workpiece are rotated and moved axially together, which common movement is made possible by the fact that the workpiece has been deformed tightly against the mandrel by the forming rolls. It will be appreciated, however, that at the beginning or start-up of a forming operation, the workpiece lies loosely on the mandrel. Hence, as the forming rolls begin to act against the workpiece, there occurs an undesirable tendency for the workpiece to be simply pulled axially relative to the mandrel, rather than being moved as a unit with the mandrel as is necessary for proper forming. Moreover, at the end of the forming operation, it is necessary to axially retract the mandrel relative to the formed workpiece to a loading position so that the mandrel can receive new workpieces to be formed. However, since the formed workpiece tightly grips the mandrel, there occurs an undesirable tendency for the formed workpiece to return with the mandrel.

In an attempt to control the workpiece in the above situations, it has been previously proposed, i.e., it is known, to provide a clamp which applies a radial clamping pressure to the workpiece in order to axially restrain the workpiece, However, that clamp did not perform acceptably because the clamping pressure required to hold the workpiece axially stationary during a loading operation was too great for the start-up procedure. That is, when a rolling operation commences, it is necessary to permit some axial movement of the workpiece, albeit under resistance, in order to prevent buckling of the workpiece as the workpiece is urged toward the rolls. If a weaker clamp is used instead, the clamping pressure is insufficient to immobilize the workpiece during the unloading operation.

Therefore, in lieu of relying on a clamp during unloading and start-up procedure, it has been customary for the operator to perform the unloading and start-up procedures in a deliberate and careful manner so as to exert proper control over the workpiece. However, this is slow and tedious and significantly retards the rate of production.

Furthermore, once a rolling operation is resumed and the workpiece has been sufficiently deformed to ensure no axial movement relative to the mandrel, the clamp discussed above is released and the workpiece and mandrel allowed to travel to the rolls unrestricted. It has been discovered, however, that the clearances thus allowed between the clamp jaws and the workpiece during forming are oftentimes detrimental to the quality of tube thus produced. The clearances allow for the workpieces to be imprecisely guided through the rolls thus causing various geometric inconsistancies and cosmetic deficiencies in the resulting tubes.

OBJECTS AND SUMMARY OF THE INVENTION

An object of the invention is to provide a method and apparatus for solving the problems enumerated above.

A further object of the invention is to provide a method and apparatus for economically and efficiently producing workpiece shafts.

A further object of the invention is to eliminate the need for additional clamping mechanisms for a mandrel and a workpiece.

BRIEF DESCRIPTION OF THE DRAWINGS

FIG. 1 is schematic side elevation of pilgering mill of the present invention;

FIG. 2 is an enlarged vertical section view showing the tube forming rolls of FIG. 1;

FIG. 3 is a plan view showing the groove in one of the tube forming rolls in FIGS. 1 and 2;

DETAILED DESCRIPTION OF THE INVENTION

Figure 4:
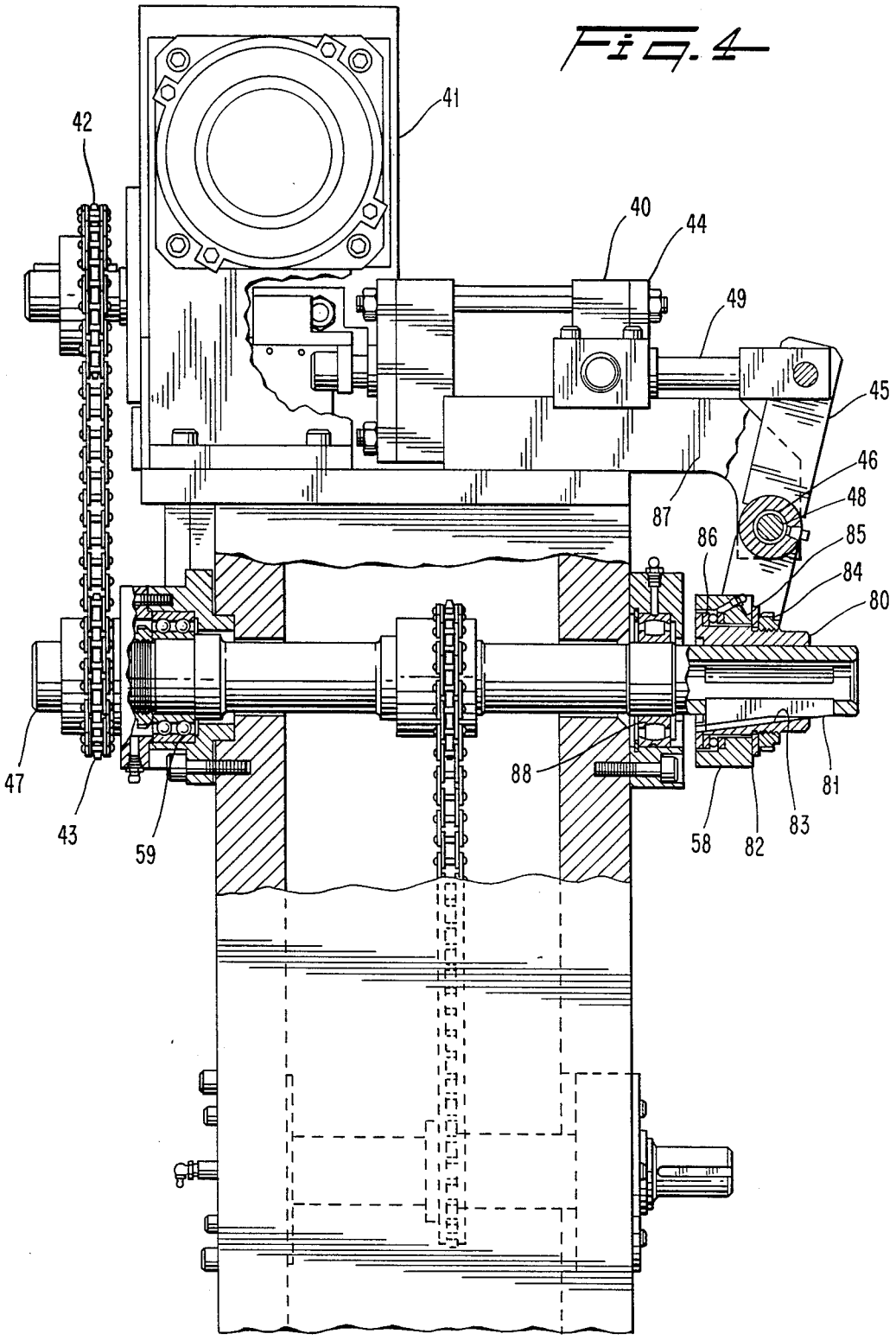
FIG. 4 is a combined clamp inlet turner used in a first embodiment of the present invention.

Referring to FIG. 1 of the drawing, a rocker mill 2 is represented schematically which includes a stationary base 4, a conventional movable chuck 6 in which is securely clamped a cylindrical mandrel 17. The mandrel is positioned within a workpiece 18 and has a uniform external diameter which is only slightly less than the internal diameter of the workpiece. The right-hand end of the workpiece 18 is shown in a forming zone 33 during the forming operation which is being performed by a pair of forming rolls 11 and 12 rotatably mounted in a conventional movable rollstand 9. Stand 9 is oscillated by a crank arm assembly 7 with the movement being such that the forming zone 33 is moved axially with respect to the workpiece.

During the forming operation, the workpiece is advanced step-by-step into the forming zone by a screw thread assembly having a threaded shaft 22 extending through a supporting bracket 26 for the chuck 6. During each step movement of the workpiece and the mandrel, the workpiece is turned about its axis a predetermined number of degrees. Turning may be performed either at the movable chuck 6 or elsewhere, as will become apparent from the following discussion.

Referring now to FIGS. 2 and 3, rolls 11 and 12 are mounted upon shafts 13 and 14, respectively, and each of them has a groove (see FIG. 3) comprising a primary forming portion 30, a finishing portion 31, and a dwell portion 32. The surfaces of portions 30 and 31 of each of the grooves have generally semicircular cross-sections the axes of which are concentric with the axis of the mandrel and the workpiece when the respective portions of the groove mate at the forming zone 33. The peripheral edges 35 of the rolls mate along a line which extends between the axis of the rolls and which intersects the axis of the workpiece. The arc of the dwell portion 32 relative to the roll is usually on the order of 60°–120°. The primary forming portion 30 is usually longer than the finishing portion 31, and the dwell portion extends the remainder of the circumference of the roll.

During operation, the rollstand oscillates to the right and left from the position shown in FIG. 1 and is in fact, moving to the right in a primary tube-forming movement of stroke. At that time, portions 30 of the grooves are engaging the workpiece, with roll 11 turning clockwise and roll 12 turning counterclockwise. The movement of the roll stand carrying the rolls relative to the rotation of the rolls is such that the finishing portions 31 of the grooves mate at their ends adjacent the dwell portions 32 when the rollstand and rolls are in the extreme right-hand position. The movement is then reversed simultaneously so that the rolls start to turn in their respective opposite directions at the same time that the rollstand starts to move the rolls to the left. Most of the reduction is normally taken on the forward stroke from the left to the right. Depending on the movement of the workpiece when the rolls roll over the workpiece, a certain amount of the deformation work can be taken during the return stroke from the right to the left.

When the rollstand approaches its extreme left-hand position, the rolls have turned so that the dwell portions 32 of the grooves are mating, i.e., little if any, pressure is applied to the workpiece. At that time, a step-feed movement is produced by turning screw shaft 22 so as to feed the workpiece and the mandrel one step to the right. Simultaneously, chuck 6 conventionally rotates the workpiece the predetermined number of degrees as referred to above. The rollstand movement is then reversed, with the leading ends of the portions 30 of the grooves (shown at the bottom of FIG. 3) moving onto the workpiece and engaging the portion of the workpiece which has been moved into the range of the rolls by the last step advance. That produces the primary tube-forming step with the metal flowing axially along the mandrel. There is a resultant increase in tube length which is manifested at the free end of the workpiece, i.e., the right-hand end depicted in FIG. 1.

The mechanisms described thus far are conventional and need not be further described. For additional details thereof, attention is directed to the disclosures of the above-described U.S. Pat. Nos. 4,233,834 and 4,655,068, the disclosures of which are incorporated herein by reference.

It will be appreciated that once the workpiece has been moved as far as possible into the forming zone of the rocker mill, the movable chuck 6 must be retracted along with the mandrel 17 in order to allow space for loading additional workpieces into the mill.

With reference to FIGS. 1 and 4, a first embodiment of the present invention is shown wherein an inlet turner/clamp 40 is mounted at an inlet of the tube-forming zone of the mill. During normal rocking operation of the mill, inlet turner/clamp 40 operates to periodically rotate the workpiece as it progresses through the rolls 11 and 12. During the reloading operation of the mill, however, the turner/clamp 40 serves to clamp the workpiece axially and thus provide for easier and more economical removal of the mandrel 17.

With reference to FIG. 4, inlet turner/clamp 40 includes a housing on which is disposed a motor 41 that drives sprocket 42 which in turn drives sprocket 43. Sprocket 43 is mounted on hollow shaft 47 through which the workpiece 18 travels as it progresses towards rolls 11 and 12. Also included on inlet turner/clamp 40 is a pneumatically actuated cylinder 44 which serves to selectively actuate piston rod 49 in a back and forth direction along the axis of the cylinder 44. Attached to piston rod 49 is yoke which comprises a pair of identical parallel arms 45 (only one arm being shown in the drawing), the arms being interconnected for common movement by a horizontal hollow cross bar 46. The cross bar 46 is hollow and is rotatably mounted on a rod 48 which is fixed at its ends to a stationary frame 87. A plurality of jaws 81 are mounted in slots formed in a front end of the shaft 47. The jaws 81 are movable radially inwardly under the urging of jaw actuator 82. The jaw actuator 82 comprises an inner sleeve 80 which is axially slidably mounted on the shaft 47 and contains inclined cam faces 83 disposed opposite corresponding inclined surfaces of the jaws. Thus, in response to axial movement of the inner sleeve 80 in one direction (i.e., to the left in FIG. 4), the jaws are displaced radially inwardly.

The inner sleeve 80 is within an outer sleeve 58 by means of a bearing 86 which permits rotation of the inner sleeve 80 relative to the outer sleeve 58 about the axis of the shaft 47. The outer and inner sleeves are secured together against relative axial displacement by means of a nut 84 which is threadedly secured to an outer surface of the inner sleeve and which bears axially against an end of the outer sleeve by means of a thrust bearing 85 interposed therebetween.

The outer sleeve 58 is connected to lower ends of the arms 45 by means of horizontal pivot pins (not shown) whereby rotation of the arms 45 produces axial movement of the jaw actuator 82 relative to the jaws 81. Rotation of the workpiece, shaft 47 jaws 81, and inner sleeve 80 relative to the outer sleeve 58 is permitted by the bearings 85, 86.

The shaft 47 is rotatably mounted in the housing of the turner clamp 40 by means of suitable bearings 59, 88 to accommodate rotation of the shaft 47.

While a rocking operation is being performed, the motor 41 will cause sprocket 42 to periodically turn a certain predetermined number of degrees. Sprocket 42 is linked to sprocket 43 via a chain thus a similar rotation will be imparted to sprocket 43. Moreover, since sprocket 43 is fixed onto hollow shaft 47, the predetermined rotation will be performed by hollow shaft 47 as well. The rotation of hollow shaft 47 will aid in the periodic rotation of workpiece 18 as it proceeds through the rolls 11 and 12.

After a rolling operation wherein movable chuck 6 has traversed the maximum allowable distance of screw shaft 22 towards rolls 11 and 12, the chuck 6 must then be retracted to allow for mounting additional workpieces. It is noted, however, that since movable chuck 6 is not capable of moving all the way to a position immediately adjacent rolls 11 and 12, at least one workpiece that has been previously loaded will remain positioned with one end immediately adjacent rolls 11 and 12 and with one end near chuck 6 as movable chuck 6 is retracted. That workpiece will constitute the next workpiece to be rolled upon resumption of the rolling operation. As movable chuck 6 is retracted, mandrel 17 is withdrawn from the workpieces already rocked and through the workpiece that remains positioned between the rolls and the chuck 6. Accordingly, before the mandrel is withdrawn, the rolls are moved to the left such that the dwell portion 32 of the tube-forming grooves are surrounding the end of the remaining workpiece. This removes any pressure that may be applied through the workpiece onto the mandrel which might restrict mandrel movement. Pneumatic cylinder 44 is then pressurized to a first pressure such that piston rod 49 is moved to the right as shown in FIG. 4. This movement causes yoke arms 45 to pivot about pivot point 46 and thus causes the jaw actuator to displace the jaws 81 radially inwardly against the workpiece under the urging of the first pressure. Following these steps, mandrel 17 is withdrawn from the workpiece by moving movable chuck 6 to the reload position at the far left-hand side of the mill. The first pressure applied to the jaws 81 is sufficient to prevent undesired axial movement of the workpiece when the mandrel is being withdrawn through the workpiece. Typically, the mandrel is withdrawn until the forward end is located in the tube-forming zone of the mill.

Once the mandrel has been withdrawn sufficiently from the workpieces already rolled and movable chuck 6 is thus located at the reload position of the mill, the mandrel 17 is released from chuck 6 to allow for additional workpieces to be slid over the mandrel 17 and positioned for movement into the rolls. Prior to such release, rolls 11 and 12 are oriented such that the primary forming portions 30 of the tube-forming grooves of the rolls 11 and 12 produce a slight deformation of the end of the workpiece over the mandrel 17. The mandrel is thus pinched and therefore axially secured even though it has been released from chuck 6. Accordingly, additional workpieces can be slid onto the mandrel without causing a displacement of the mandrel. Additionally, the pressure from cylinder 44 is maintained on jaws 81 to continue to prevent the axial movement of the workpiece thus further precluding movement of the mandrel. After the additional workpieces have been loaded over the mandrel 17, rocking operation of the mill can be resumed.

As rocking operation of the mill is resumed, however, the first pressure applied by cylinder 44 to jaws 81 and, therefore, to the workpiece is reduced to a second pressure. The second pressure is sufficient to exert a yieldable resistance against axial movement of the workpiece so that the rolls 11, 12 can deform the workpiece into tight contact with the mandrel 17. In the absence of such second pressure at the resumption of rocking, the workpiece might be pulled through the rolls 11 and 12 without similar movement of the mandrel. Moreover, if the first pressure were maintained, no axial movement of the workpiece would be permitted whereby buckling of the workpiece could occur due to the axial forces imposed by the crosshead 6. The second pressure enables the workpiece to be axially displaced if necessary to avoid being buckled by the axial force imposed by the crosspiece 6. When the mandrel has been sufficiently pinched by the workpiece, the pressure on jaws 81 is released by causing cylinder 44 to actuate piston rod 49 in the direction towards cylinder 44 which thus allows the workpiece to freely travel towards rolls 11 and 12 and their tube forming grooves.

Figure 6:
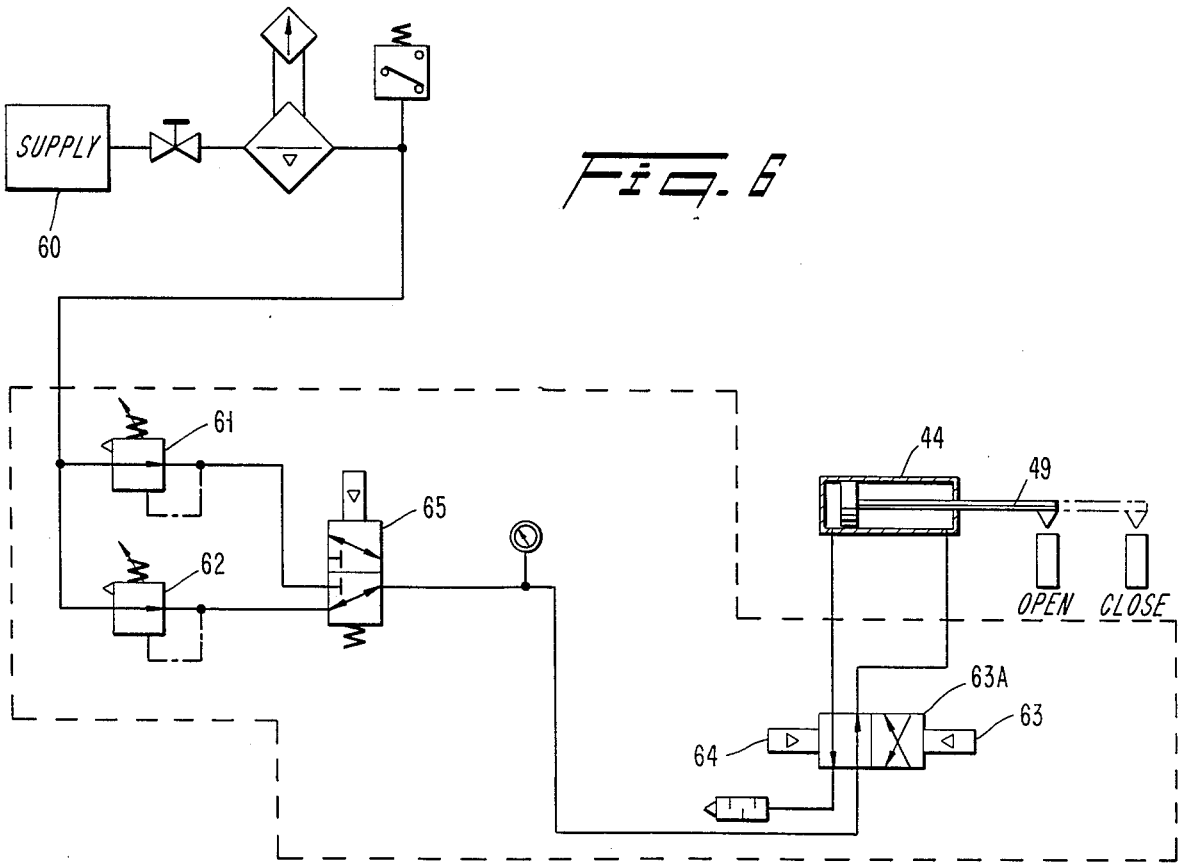
FIG. 6 is a schematic of the pneumatic system used in the combined clamp inlet turner shown in FIG. 4.

With reference now to FIG. 6, a schematic of a pneumatic system that is used to operate cylinder 44 in the first and second pressure modes is shown. The pneumatic system includes a pressurized air source 60 connected to an inlet high-pressure regulator 61, and an inlet low-pressure regulator 62 which are connected to a solenoid valve 65. A first solenoid 63, and a second solenoid 64 are operably connected to a spool valve 63A which controls a pneumatic cylinder 44. As depicted in FIG. 6, the valves 63A, 65 are in position such that cylinder 44 is causing inlet turner clamp 40 to be opened. That is, pressure from air supply 60 is exerted through low pressure regulator 62, through unenergized solenoid valve 65, through valve 63A as energized by solenoid 63, to that portion of cylinder 44 that causes actuation of piston rod 49 into cylinder 44. This causes jaws 81 to be in a released condition.

When it is necessary to retain the workpiece in an axial location such as is desired when mandrel 17 is to be retracted, the solenoid valve 65 and the solenoid 64 are energized to cause a first pressure from high-pressure regulator 61 to be conducted to that portion of cylinder 44 which causes extension of piston rod 49 from cylinder 44. This causes jaws 81 to press against the workpiece at the first (high) pressure. The pneumatic system is controlled by an electronic controller such as is commonly known.

After additional workpieces have been loaded into the mill, it is important to axially restrain the next workpiece to be rolled until the mandrel is pinched therein as discussed above. The pneumatic system allows for this restraint by applying a second pressure to the piston rod 49 in response to suitable positioning of the valves 65, 63A. In this manner, pressure is conducted through low-pressure regulator 62, to that portion of cylinder 41 that actuates piston rod 49 such that jaws 50 press against the workpiece at reduced pressure.

Figure 5:
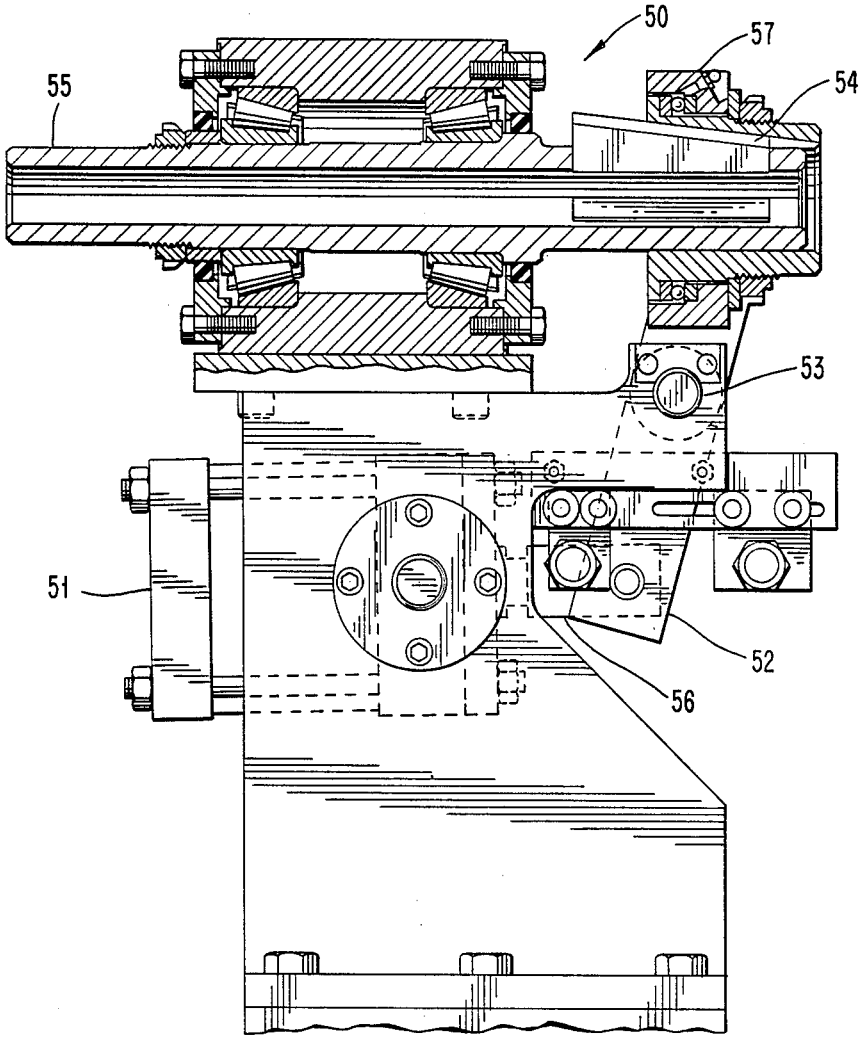
FIG. 5 is a clamp used in a second embodiment of the present invention.

With reference now to FIG. 5, a second embodiment of the present invention is now described wherein a clamp 50 replaces the afore-described turner/clamp 40. Unlike the inlet turner/clamp 40, the clamp 50 as shown in FIG. 5 serves only a clamping function. That is, clamp 50 is not used to periodically turn the workpiece as it progresses through rolls 11 and 12. Clamp 50 does include, however, an additional clamping feature which could, if desired, be included in inlet turner/clamp 40 that is especially helpful in properly resuming a roll operation following the reloading of the mill.

Clamp 50 is similar to the turner clamp 40 in that it includes a pneumatic cylinder 51 which actuates piston rod 56. Piston rod 56 is attached to the arms of a yoke 52 which is attached to a jaw actuator 57 constructed identically to the actuator 50 disclosed earlier herein. Yoke arms 52 are pivotable around pivot point 53 and turner jaws 54 surround hollow shaft 55 through which the workpiece travels.

After a rolling operation wherein movable chuck 6 has traversed the maximum allowable distance of screw shaft 22 towards rolls 11 and 12, the chuck 6 must then be retracted to allow for mounting additional workpieces. It is noted, however, that since the chuck 6 is not capable of moving all the way to a position immediately adjacent rolls 11 and 12, at least one workpiece that has been previously loaded will remain positioned with one end immediately adjacent rolls 11 and 12 and with one end towards chuck 6 as movable chuck 6 is retracted. It will be the next workpiece to be rolled upon resumption of the rolling operation after reloading the mill. As movable chuck 6 is retracted, mandrel 17 is withdrawn from workpieces already rocked and through the workpiece that remains positioned between the rolls and the chuck 6. As a result, before the mandrel is withdrawn, the rolls are moved to the right such that the dwell portion 32 of the tube-forming grooves are surrounding the end of the remaining workpiece. This removes any pressure that may be applied through the workpiece onto the mandrel which might restrict mandrel movement. Pneumatic cylinder 51 is then pressurized to a first pressure such that piston rod 56 is moved to the left. This movement causes yoke 52 to pivot about pivot point 53 and thus encourage turner jaws 54 to compress onto the workpiece that is located within hollow shaft 55. Following these steps, mandrel 17 is withdrawn from the workpiece by moving movable chuck 6 to the reload position at the far side of the mill. The-first pressure applied to the jaws 54 through the cylinder 51 is sufficient to prevent any axial movement of the workpiece when the mandrel is being withdrawn from the workpiece. Typically, the mandrel is withdrawn until the forward end is located in the tube-forming zone of the mill.

Once the mandrel has been withdrawn sufficiently from the workpieces already rolled and movable chuck 6 is thus located at the reload position of the mill, mandrel 17 must be released from chuck 6 to allow for additional workpieces to be slid over the extended portion of mandrel 17 and thus positioned for movement into the rolls. Before doing so, the rolls 11 and 12 are oriented such that the primary forming portion 30 of the tube-forming grooves of the rolls 11 and 12 produce a slight deformation of the end of the workpiece over the mandrel 17. The mandrel is thus pinched and therefore axially secured even though it has been released from chuck 6. Additionally, the pressure from cylinder 51 is maintained on jaws 54 at the first pressure to also prevent the axial movement of the workpiece thus further precluding movement of the mandrel. After the additional workpieces have been loaded over the mandrel 17, rocking operation of the mill can be resumed.

As rocking operation of the mill is resumed, however, a second pressure is applied by cylinder 51 to jaws 54 and, therefore, to the workpiece to resist axial movement thereof until sufficient deformation has occurred to secure the workpiece onto the mandrel 17. The second pressure applied at the resumption of rolling is lower than the first pressure applied during retraction of the mandrel. The second pressure restricts axial movement of the workpiece against the forces imposed by the rolls 11, 12, but permits the workpiece to move axially if necessary to prevent buckling under the axial force imposed by the movable chuck 6.

When the mandrel has been sufficiently pinched by the workpiece, the jaws 54 around the workpiece are further released by causing cylinder 51 to assume a differential pressure mode. Cylinder 51 causes piston rod 56 to be actuated to a position midway between its two extreme positions. This causes jaws 54 to lightly compress around the workpiece and thus provide a gentle guide as the workpiece traverses to and through rolls 11 and 12. The guiding thus provided removes undesired clearance that occurs if the clamp is simply released as in the first embodiment. As a result, since the workpiece is less free to move while traveling through the rolls, there is a greater consistency in the geometric formation resulting from forming and less cosmetic deficiencies occurring on the formed tubes.

Figure 7:
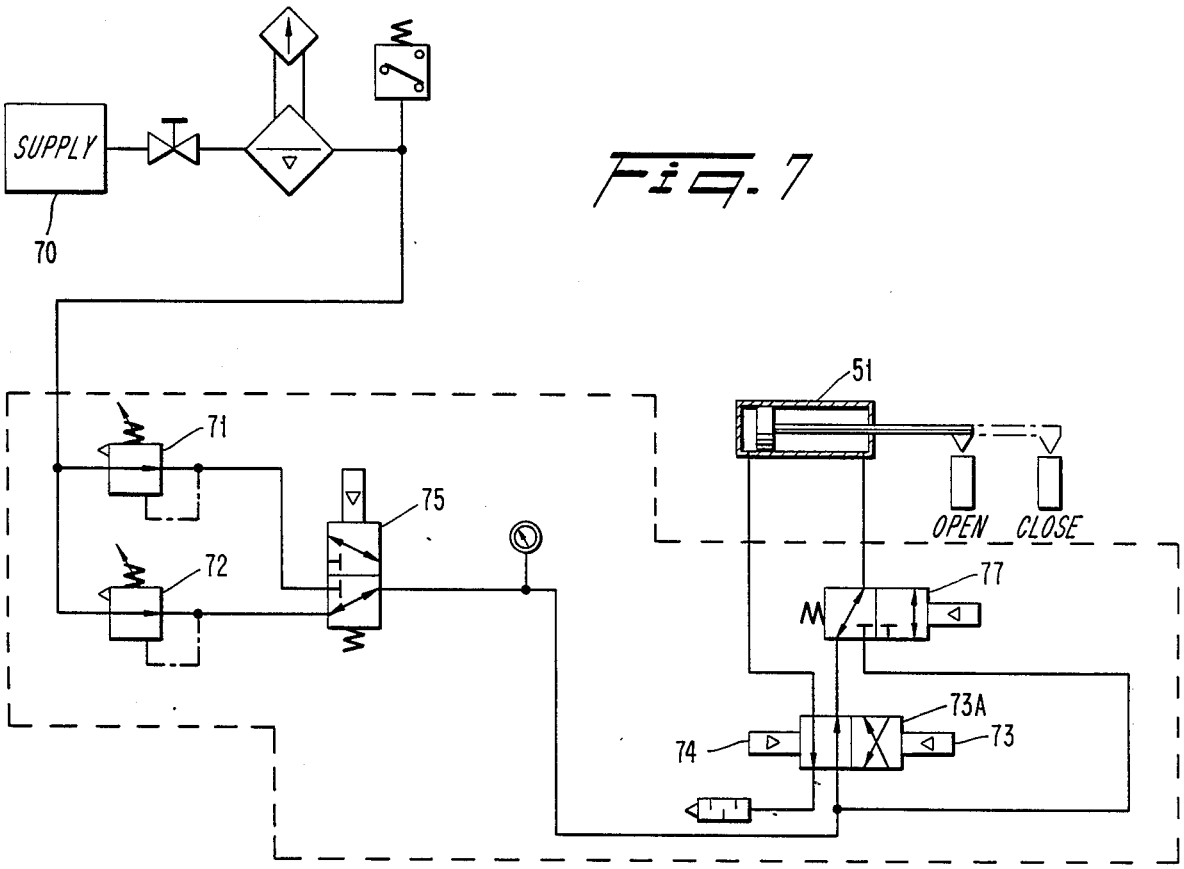
FIG. 7 is a schematic of the pneumatic system used in the clamp shown in FIG. 5.

With reference now to FIG. 7, a schematic is shown for the operation of cylinder 51 of the second embodiment described above. The system includes air supply 70, which is connected to inlet high-pressure regulator 71, and inlet low-pressure regulator 72. The regulators are connected to solenoid valve 75. A first solenoid 73 and a second solenoid 74 are operably connected to a spool valve 73A which controls pneumatic cylinder 51. Valve 73A is connected to differential pressure solenoid valve 77 which is connected to cylinder 51. Valve 73A is also connected to the opposite side of cylinder 51. An electronic control unit is not shown.

The system as depicted in FIG. 7 shows the orientation of valves when inlet clamp 50 is open. Pressure from the air supply is exerted through low-pressure regulator 72, through unenergized solenoid valve 75, through valve 73A as energized by solenoid 73, through unenergized differential pressure solenoid valve 77, to that portion of cylinder 51 that causes piston rod 56 to actuate such that jaws 54 are not compressing upon the workpiece.

When it is desired to hold the workpiece in axial location when a mandrel is to be retracted and allow for the mounting of additional workpieces, high pressure solenoid valve 75 and solenoid valve 74 are energized accordingly. This causes a first pressure to flow through inlet high pressure regulator 71, through energized solenoid valve 75, through valve 73A as energized by solenoid 74, to that portion of cylinder 51 that causes piston rod 56 to actuate such that jaws 54 firmly clamp onto the workpiece.

After additional workpieces have been loaded into the mill, it is important to axially restrain the next workpiece to be rolled until the mandrel is pinched therein as described previously with respect to the first embodiment. The pneumatic system allows for this restraint by allowing a second, lower pressure to actuate piston rod 56 when solenoid 74 alone is energized. In this manner, the second pressure is exerted through inlet-low pressure regulator 72, through unenergized solenoid valve 75, through valve 73A as energized by solenoid 74, to that portion of cylinder 51 that actuates piston rod 56 such that jaws 54 compress upon the workpiece.

Once the workpiece has been rolled sufficiently to secure the workpiece onto mandrel 17, the second pressure exerted by jaws 54 is no longer necessary. The pressure applied by jaws 54 is then reduced to a differential pressure upon the energization of differential pressure solenoid valve 77 and solenoid 73. In this manner, the differential pressure is exerted through low pressure regulator 72, through unenergized solenoid valve 75, through valve 73A as energized by solenoid 73 which then directs pressure to both sides of cylinder 51. One side of cylinder 51 is filled by pressure coming directly from valve 73A while the other side of cylinder 51 is filled with pressure through differential pressure solenoid valve 77. In this manner, piston rod 56 is actuated to be between the open and closed position. This causes jaws 54 to exert a very moderate force on the workpiece to aid in guiding the workpiece through rolls 11 and 12.

While the above description describes a function of the invention wherein the mandrel travels with the workpiece through the rolls, the invention is also useful in what is referred to as a side loading tube reducer. Such a machine similarly uses a mandrel, however the mandrel is tapered at the end located nearest the rolls and maintained axially stationary while the workpiece travels through the rolls. To reload the machine, the mandrel is completely retracted from the workpiece next in line to be rolled to a distance such that space is available for loading additional workpieces from the side of the machine. Upon side loading additional workpieces, the mandrel is inserted into the additional workpieces until the tapered portion is again located in the workpiece next in line for rolling. Rolling is then resumed. The clamp of the present invention axially secures the workpiece next in line to be rolled during retraction of the mandrel by applying a first pressure. The first pressure is reduced to a second pressure at the resumption of a rolling operation and to a differential pressure thereafter as described above. In certain circumstances, the first pressure may be reduced directly to the differential pressure since some side loading machines may not need the clamp to cause the workpiece to resist axial movement.

Similarly, the present invention is useful in an end-loading machine that also uses a stationary tapered mandrel. In this particular machine, when reloading is desired, the mandrel is not retracted from the workpiece next in line to be rolled but is instead simply released at the end of the machine opposite the rolls in a conventional manner. This allows additional workpieces to be slidingly positioned over the mandrel from the end opposite the rolls. When the additional workpieces are being mounted over the mandrel, they will occasionally knock against the workpiece next in line to be rolled thus tending to displace it out of position. The clamp of the present invention axially secures the workpiece next in line to be rolled with a first pressure so that the knocking caused by the loading of additional workpieces does not effect positioning thereof. Following completion of loading, the clamp of the present invention operates in the same manner as described with respect to the side loading machine.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limiting to the scope and spirit of the invention as set forth in the appended claims.

What is claimed:

1. A method of reloading a pilgering mill of the type having a pair of forming rolls with tube-forming grooves disposed thereon, a first hollow workpiece positioned at a location adjacent the rolls and a mandrel disposed within the hollow workpiece, comprising the steps of:

a. clamping said first workpiece with a first pressure sufficient to hold said first workpiece stationary in the axial direction;

b. retracting said mandrel relative to said first workpiece while said first workpiece is held stationary by said first pressure;

c. sliding at least one additional workpiece over a retracted portion of said mandrel;

d. reducing said first pressure to a second pressure which is sufficient to yieldably resist axial movement of said first workpiece at the start-up of a subsequent rolling operation;

e. beginning a rolling operation by reciprocating said forming rolls against said first workpiece while said first workpiece is held by said second pressure; and f. maintaining said second pressure while said first workpiece becomes deformed tightly against said mandrel.

2. The method of claim 1, further including prior to step (b), the step of positioning said rolls such that said tube-forming grooves permit retraction of the mandrel through the workpiece.

3. The method of claim 1, further including subsequent to step (b) and prior to step (c); the step of repositioning said forming rolls such that said forming grooves deform said first workpiece against said mandrel to secure said mandrel against said first workpiece during step c.

4. The method of claim 1, further including subsequent to step (f), the step of reducing the second pressure applied to said first workpiece to a differential pressure, which guides said workpiece into said rolls.

5. The method of claim 1, further including subsequent to step (f), the step of removing said second pressure applied to said first workpiece such that said workpiece is unrestricted as said workpiece travels into said rolls.

6. A pilgering mill for producing hollow tubes from hollow workpieces comprising:

a reciprocating roll stand;

a pair of metal forming rolls mounted in said reciprocating roll stand;

tube-forming grooves circumferentially disposed on each of said pair of metal forming rolls, said grooves forming a tube-forming zone at a plane where circumferences of said pair of rolls mate, said tube-forming zone sized to receive a workpiece;

a mandrel arranged to be disposed within a workpiece;

means for retracting said mandrel; and clamping means located at an inlet to said tube-forming zone for applying a first pressure to the workpiece sufficient to prevent movement of the workpiece during retraction of said mandrel through the workpiece and for providing a second reduced pressure for yieldably resisting axial movement of the workpiece at the start-up of a subsequent rolling operation.

7. A pilgering mill according to claim 6, said clamping means further providing a differential pressure less than said second pressure for guiding said workpiece through said rolls during a rolling operation.

8. A method of producing hollow tubes from a pilger mill of the type having a pair of forming rolls with tube-forming grooves disposed thereon, a first hollow workpiece positioned at a location adjacent the rolls and a mandrel disposed within the hollow workpiece, comprising the steps of:

a. clamping said first workpiece with a first pressure sufficient to hold said first workpiece stationary in the axial direction;

b. retracting said mandrel relative to said first workpiece while said first workpiece is held stationary by said first pressure;

c. sliding at least one additional workpiece over a retracted portion of said mandrel; and d. reducing said first pressure to a second pressure which is sufficient to yieldably resist axial movement of said workpiece at the start-up of a subsequent rolling operation;

e. beginning a rolling operation by reciprocating said forming rolls and axially advancing said workpiece into and through said tube-forming grooves while said first workpiece is held by said second pressure;

f. maintaining said second pressure while said first workpiece becomes deformed tightly against said mandrel; and g. continuing reciprocating movement of said rolls and advancing movement of said first workpiece to reduce the outer diameter of said first workpiece over the entire length thereof.

9. The method of claim 8, further including subsequent to step (f) and prior to step (g), the step of reducing the second pressure applied to said first workpiece to a differential pressure, which guides said workpiece into said rolls.

10. The method of claim 8, further including subsequent to step (f) and prior to (g), the step of removing said second pressure applied to said first workpiece such that said workpiece is unrestricted as said workpiece travels into said rolls.

11. A method of reloading a pilgering mill of the type having a pair of forming rolls with tube-forming grooves disposed thereon, a first hollow workpiece positioned at a location adjacent the rolls and a mandrel disposed within the hollow workpiece and held axially stationary by a clamp at a location on the mill opposite the rolls, comprising the steps of:

a. clamping said first workpiece with a first pressure sufficient to hold said first workpiece stationary in the axial direction;

b. releasing the mandrel from the clamp holding said mandrel axially stationary;

c. sliding at least one additional workpiece axially over the mandrel at the location where the mandrel is released until said at least one additional workpiece is positioned adjacent said first workpiece;

d. clamping said mandrel to be axially stationary;

e. reducing said first pressure to a second pressure which is sufficient to yieldably resist axial movement of said first workpiece at the start-up of a subsequent rolling operation;

f. beginning a rolling operation by reciprocating said forming rolls against said first workpiece while said first workpiece is held by said second pressure;

g. maintaining said second pressure while said first workpiece becomes deformed against said mandrel.

12. The method of claim 11, further including subsequent to step (g), the step of reducing the second pressure applied to said first workpiece to a differential pressure, which guides said workpiece into said rolls.

13. The method of claim 11, further including subsequent to step (g), the step of removing said second pressure applied to said first workpiece such that said workpiece is unrestricted as said workpiece travels into said rolls.

14. A method of reloading a pilgering mill of the type having a pair of forming rolls with tube-forming grooves disposed thereon, a first hollow workpiece positioned at a location adjacent the rolls and a mandrel disposed within the hollow workpiece and held axially stationary by a clamp at a location on the mill opposite the rolls, comprising the steps of:

a. clamping said first workpiece with a first pressure sufficient to hold said first workpiece stationary in the axial direction;

b. releasing the mandrel from the clamp holding said mandrel axially stationary;

c. sliding at least one additional workpiece axially over the mandrel at the location where the mandrel is released until said at least one additional workpiece is positioned adjacent said first workpiece;

d. clamping said mandrel to be axially stationary;

e. reducing the second pressure applied to said first workpiece to a differential pressure, which guides said workpiece into said rolls during a rolling operation;

f. beginning a rolling operation by reciprocating said forming rolls against said first workpiece while said first workpiece is guided by said differential pressure;

g. maintaining said differential pressure while said first workpiece travels through said rolls.

15. A pilgering mill for producing hollow tubes from hollow workpieces comprising:

a reciprocating roll stand;

a pair of metal forming rolls mounted in said reciprocating roll stand;

tube-forming grooves circumferentially disposed on each of said pair of metal forming rolls, said grooves forming a tube-forming zone at a plane where circumferences of said pair of rolls mate, said tube-forming zone sized to receive a workpiece;

a mandrel arranged to be disposed within a workpiece;

clamping means located at an inlet to said tube-forming zone for applying a first pressure to the workpiece sufficient to prevent movement of the workpiece during occasional knocking of additional workpieces loaded over said mandrel and for providing a second reduced pressure for yieldably resisting axial movement of the workpiece at the start-up of a subsequent rolling operation.

16. A pilgering mill according to claim 15, said clamping means further providing a differential pressure less than said second pressure for guiding said workpiece through said rolls during a rolling operation.

* * * * *